US008944013B2

(12) United States Patent
Min

(10) Patent No.: US 8,944,013 B2
(45) Date of Patent: Feb. 3, 2015

(54) PIPE CONNECTING STRUCTURE OF WATER HEATER

(75) Inventor: Tae-Sik Min, Seoul (KR)

(73) Assignee: Kyungdong Navien Co., Ltd., Gyeonggi-do (KR)

( * ) Notice: Subject to any disclaimer, the term of this patent is extended or adjusted under 35 U.S.C. 154(b) by 402 days.

(21) Appl. No.: 13/509,011

(22) PCT Filed: Nov. 11, 2010

(86) PCT No.: PCT/KR2010/007959
§ 371 (c)(1),
(2), (4) Date: May 10, 2012

(87) PCT Pub. No.: WO2011/068313
PCT Pub. Date: Jun. 9, 2011

(65) Prior Publication Data

US 2012/0227681 A1 Sep. 13, 2012

(30) Foreign Application Priority Data

Dec. 3, 2009 (KR) ..... 10-2009-0119439

(51) Int. Cl.
*F24H 9/12* (2006.01)
*F24H 9/14* (2006.01)

(52) U.S. Cl.
CPC ..... *F24H 9/122* (2013.01); *F24H 9/14* (2013.01); *F24H 9/142* (2013.01)
USPC ..... 122/19.1; 122/14.3; 110/325

(58) Field of Classification Search
CPC ..... F24H 1/0081; F24H 1/18; F24H 4/04; F24H 9/122; F24H 9/142; F24H 9/2007
USPC ..... 122/14.3, 14.31, 19.1, 406.1, 408.1, 122/414, 511; 165/134.1, 240, 297; 110/325
See application file for complete search history.

(56) References Cited

U.S. PATENT DOCUMENTS 5,058,804 A * 10/1991 Yonekubo et al. ..... 236/12.12
7,316,267 B2 * 1/2008 Kunimoto et al. ..... 165/240
(Continued)

FOREIGN PATENT DOCUMENTS

JP 62-100455 U 6/1987
JP 8-136051 A 5/1996
(Continued)

OTHER PUBLICATIONS

Korean Intellectual Property Office, International Search Report in International Patent Application PCT/KR2010/007959 (Aug. 2, 2011).

*Primary Examiner* — Gregory A Wilson
(74) *Attorney, Agent, or Firm* — Leydig, Voit & Mayer

(57) ABSTRACT

A pipe connecting structure of a water heater. Individual parts in the water heater are integrally coupled with a pipe body, which is injection-molded, provides paths of tap water and hot water, reduces the number of pipes connecting the individual parts, and simplifies the connection structure of the pipes. The pipe connecting structure of the water heater includes a tap water inlet pipe connected from a tap water inlet to a heat exchanger; a hot water supply pipe connected from the heat exchanger to a hot water outlet; a flow sensor for measuring the flow rate of the tap water introduced via the tap water inlet; and a flow control valve for controlling the flow rate of the hot water discharged via the hot water outlet. The pipe body connects and is integral with the tap water inlet, the tap water inlet pipe, the hot water supply pipe, and the hot water outlet.

5 Claims, 3 Drawing Sheets

(56) References Cited

U.S. PATENT DOCUMENTS

| | | | | |
|---|---|---|---|---|
| 7,398,778 | B2 * | 7/2008 | Kaiser | 126/101 |
| 7,597,066 | B2 * | 10/2009 | Shimada et al. | 122/18.1 |
| 2010/0122668 | A1 * | 5/2010 | Ando | 122/14.3 |
| 2013/0081727 | A1 * | 4/2013 | Sugie et al. | 137/862 |

FOREIGN PATENT DOCUMENTS

| | | | |
|---|---|---|---|
| JP | 9-4927 | A | 1/1997 |
| JP | 2003-322411 | A | 11/2003 |
| KR | 2003-0026604 | A | 4/2003 |

* cited by examiner

PRIOR ART

PIPE CONNECTING STRUCTURE OF WATER HEATER

TECHNICAL FIELD

The present invention relates to a pipe connecting structure of a water heater, and more particularly, to a pipe connecting structure of a water heater coupled to a pipe body, in which individual parts in the water heater are integrally injection-molded, to form a flow path of tap water and hot water, reducing the number of pipes connecting the individual parts and simplifying the pipe connecting structure.

BACKGROUND ART

In general, a water heater is an apparatus configured to heat cold water to a predetermined temperature within a short time so that a user can conveniently use hot water.

FIG. 1 is a schematic view showing a configuration of a conventional water heater.

Reviewing the configuration of the conventional water heater 10, a filter 1 configured to filter foreign substances included in tap water introduced therethrough to purify the tap water and a flow rate sensor 2 configured to measure a flow rate of the introduced tap water are installed on a tap water inlet pipe 5 through which the tap water is introduced, the tap water introduced into a heat exchanger 8 is heated by heat exchange with combustion heat generated by combustion of air supplied from a blower 6 and a gas by a burner 7 to be discharged through a hot water supply pipe 9, and a flow rate control valve 4 configured to control a flow rate of the hot water is installed on a hot water supply pipe 9.

In addition, a bypass pipe 5*a* configured to directly convey the introduced tap water to the hot water supply pipe 9, not through the heat exchanger 8, is connected between the tap water inlet pipe 5 and the hot water supply pipe 9 so that the hot water heated through the heat exchanger 8 is mixed with the tap water to control a temperature of the hot water.

Further, a mixing valve 3 is installed on the bypass pipe 5*a* to control a flow rate of the tap water conveyed through the bypass pipe 5*a*.

FIG. 2 is a cross-sectional view showing the conventional pipe connecting structure of the water heater.

The conventional water heater 10 has a structure in which a flow path including the tap water inlet pipe 5, the hot water supply pipe 9 and the bypass pipe 5*a* is formed in the water heater housing 11, and a plurality of pipes are connected on the tap water inlet pipe 5, the hot water supply pipe 9 and the bypass pipe 5*a* to install the flow rate sensor 1, the flow rate control valve 4 and the mixing valve 3.

That is, the tap water inlet pipe 5 connected from the tap water inlet A to the heat exchanger 8 has a structure in which a plurality of connecting pipes 21*a*, 21, 22 and 23 are fastened to each other, the hot water supply pipe 9 connected from the heat exchanger 8 to a hot water outlet B has a structure in which a plurality of connecting pipes 24, 25, 26 and 26*a* are fastened to each other, and the bypass pipe 5*a* also has a structure in which a plurality of connecting pipes 22 and 25 are fastened to each other.

In addition, a fastening part between the connecting pipes is fixed by a fastening member 30 such as a clip, etc., to keep a fluid hermetically sealed.

As the conventional pipe connecting structure of the water heater is configured to connect the connecting pipes adjacent to both ends of the flow rate sensor 1, the mixing valve 3 and the flow rate control valve 4, as shown by ① to ⑫ of FIG. 2, the number of fastening parts between the connecting pipes is excessive and a pipe structure is complicated, thereby increasing probability of leakage between the fastening parts.

Further, in order to perform maintenance of the flow rate sensor 1, the mixing valve 3 and the flow rate control valve 4, since the fastening parts ① and ② of both ends of the flow rate sensor 1, the fastening parts ③ and ④ of both ends of the mixing valve 3 and the fastening parts ⑨ and ⑩ of both ends of the flow rate control valve 4 should be separated, the maintenance cannot be easily performed and an operation thereof takes much time.

Technical Problem

In order to solve the foregoing and/or other problems, it is an aspect of the present invention to provide a pipe connecting structure of a water heater configured to connect individual parts in the water heater, reducing the number of pipes constituting a flow path of tap water and hot water and simplifying the pipe connecting structure.

It is another aspect of the present invention to provide a pipe connecting structure of a water heater in which a flow rate sensor, a mixing valve and a flow rate control valve on/from a flow path in the water heater can be easily installed and separated.

Technical Solution

The foregoing and/or other aspects of the present invention may be achieved by providing a pipe connecting structure of a water heater, which includes: a tap water inlet pipe connected to a heat exchanger at a tap water inlet, a hot water supply pipe connected to a hot water outlet at the heat exchanger, a flow rate sensor configured to measure a flow rate of tap water introduced into the tap water inlet, and a flow rate control valve configured to control a flow rate of hot water discharged to the hot water outlet, characterized in that a pipe body configured to connect the tap water inlet, the tap water inlet pipe, the hot water supply pipe and the hot water outlet is integrally formed.

The pipe connecting structure of the water heater may further include a bypass flow path connected between the tap water inlet pipe and the hot water supply pipe, and a mixing valve configured to control the flow rate of the tap water conveyed through the bypass flow path, wherein the bypass flow path is integrally formed with the pipe body.

The flow rate sensor and the flow rate control valve may be inserted and coupled in a direction parallel to a flow path direction toward an outlet side of a fluid from the outside of the pipe body.

The mixing valve may be inserted and coupled in a direction parallel to the flow path direction of the outlet of the fluid from the outside of the pipe body.

A mixing valve insertion part and a flow rate control valve insertion part formed at the pipe body such that the mixing valve and the flow rate control valve are inserted thereinto may each have fastening parts, and the fastening parts may each be coupled by fastening members.

A flow rate sensor insertion part into which the flow rate sensor is inserted may be formed at one side of the tap water inlet to be exposed to the outside of the water heater housing.

The pipe body may include a tap water inlet part coupled to a connecting pipe through which tap water is introduced, a flow rate sensor insertion part in communication with the tap water inlet part, downwardly inclined from one side of the tap water inlet part and extending to be exposed to the outside of a water heater housing, and into which the flow rate sensor is inserted, and a mixing valve insertion part extending to one side of an upper end of the flow rate sensor insertion part so that the mixing valve is inserted thereinto, and coupled to a connecting pipe of a tap water inlet pipe through which tap water is introduced into the heat exchanger, wherein a flow path is formed such that the tap water introduced into the tap water inlet part is introduced into the flow rate sensor insertion part in a downwardly inclined direction, and then conveyed toward the mixing valve insertion part.

Advantageous Effects

According to the pipe connecting structure of the water heater according to the present invention, as the tap water inlet of the water heater, the tap water inlet pipe, the hot water supply pipe, the bypass flow path and the hot water outlet are connected by the integrally injection-molded pipe body, the number of connecting pipes can be reduced, and the pipe connecting structure can be simplified.

In addition, according to the present invention, the flow rate sensor, the mixing valve and the flow rate control valve can be easily installed on and separated from the flow path in the water heater, and thus, a maintenance operation can be easily performed.

DESCRIPTION OF DRAWINGS

The above and other aspects and advantages of the present invention will become apparent and more readily appreciated from the following description of exemplary embodiments, taken in conjunction with the accompanying drawings of which.

DESCRIPTION OF MAJOR REFERENCE NUMERALS

Figure 1:
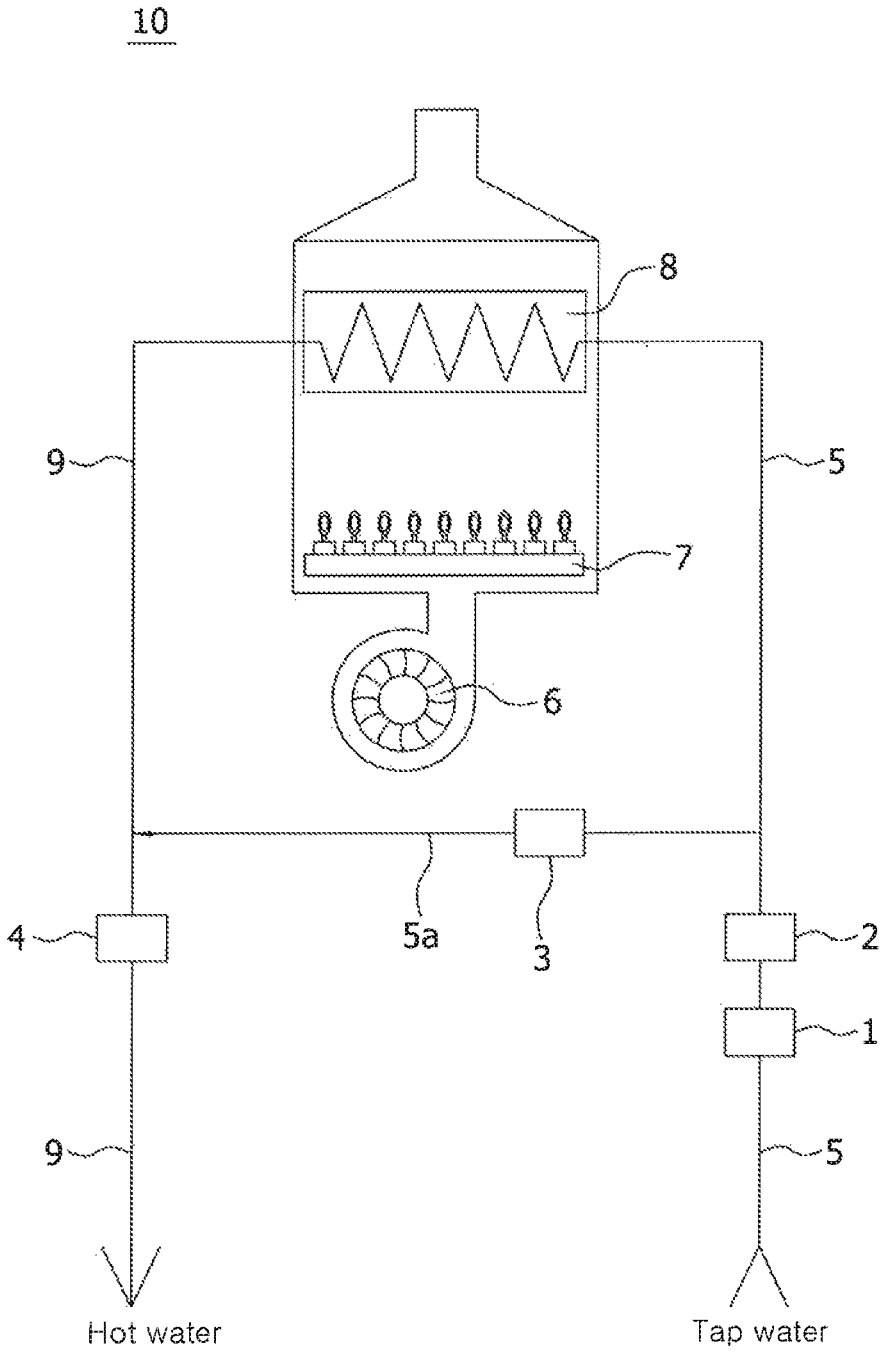
Fig. 1 PRIOR ART
FIG. 1 is a schematic view showing a configuration of a conventional water heater.
Figure 2:
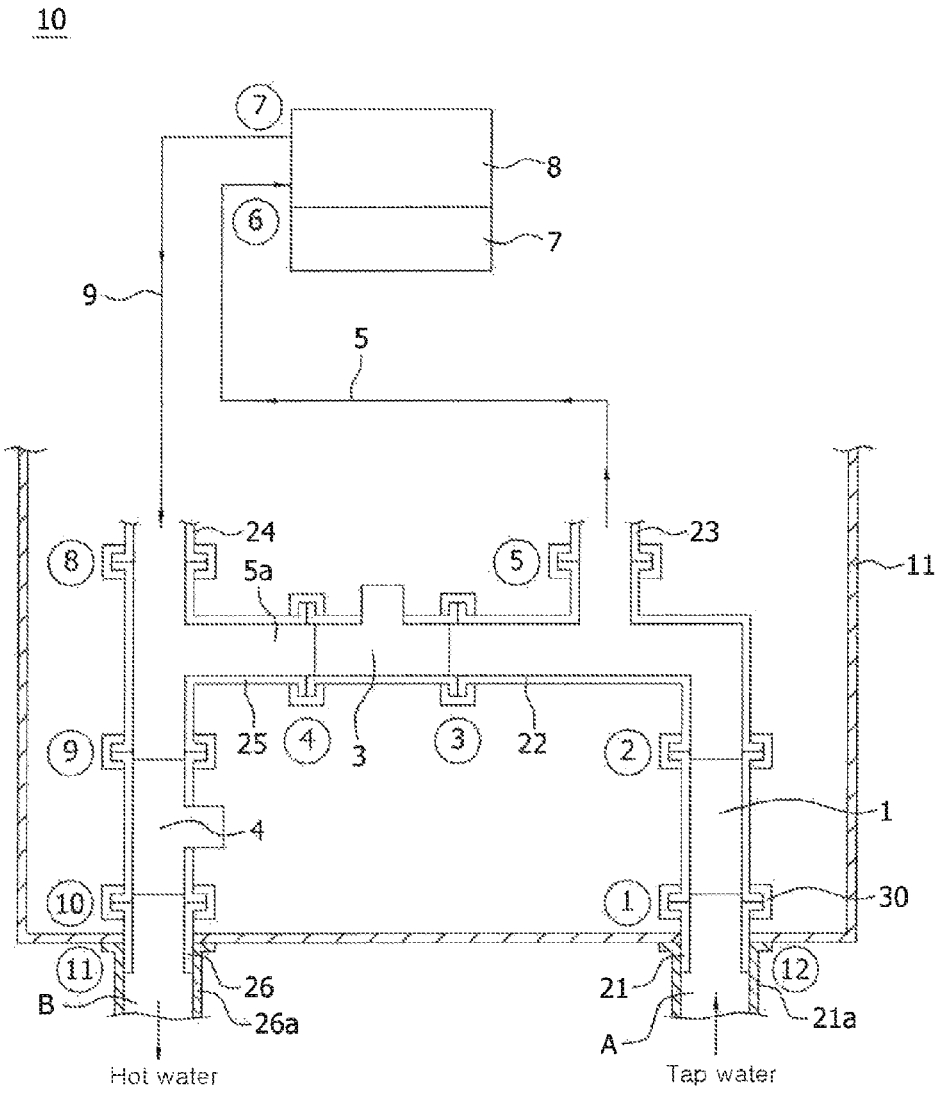
FIG. 2 is a cross-sectional view showing the conventional pipe connecting structure of the water heater.

1: Filter
2, 130: Flow rate sensor
3, 140: Mixing valve
4, 150: Flow rate control valve
5: Tap water inlet pipe
5*a*: Bypass pipe
6: Blower
7: Burner
8: Heat exchanger
9: Hot water supply pipe
10, 100: Water heater
11, 110: Water heater housing
120: Pipe body
121: Tap water inlet part
122: Flow rate sensor insertion part
123: Mixing valve insertion part
124: Hot water outlet part
125: Flow rate control valve insertion part
A: Tap water inlet
B: Hot water outlet
C: Bypass flow path

MODE FOR INVENTION

Reference will now be made in detail to the embodiments of the present invention, examples of which are illustrated in the accompanying drawings. However, it will be apparent to those skilled in the art that the following embodiments can be readily understood and modified into various types, and the scope of the present invention is not limited to the embodiments.

Figure 3:
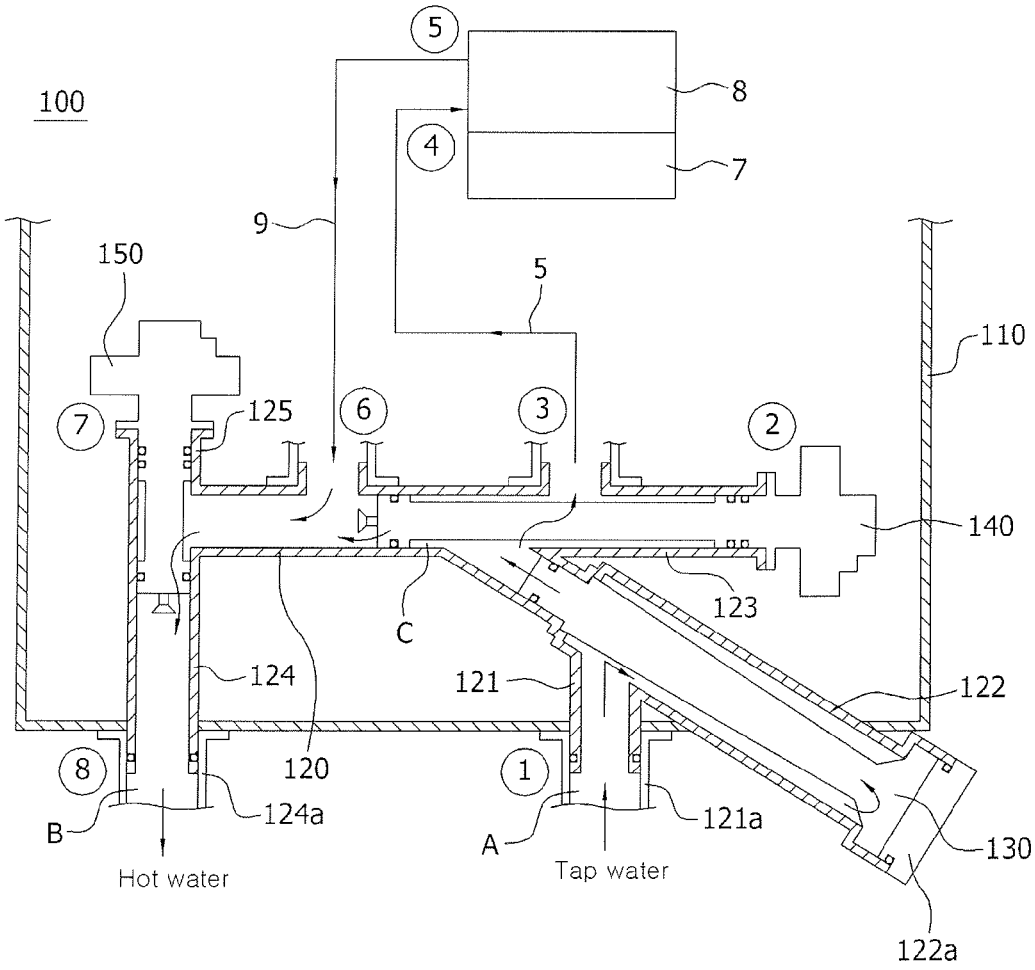
FIG. 3 is a cross-sectional view showing a pipe connecting structure of a water heater in accordance with an exemplary embodiment of the present invention.

FIG. 3 is a cross-sectional view showing a pipe connecting structure of a water heater in accordance with an exemplary embodiment of the present invention.

The pipe connecting structure of the water heater in accordance with the present invention is characterized in that a tap water inlet pipe 5 connected to a heat exchanger 8 at a tap water inlet A of a water heater 100, a hot water supply pipe 9 connected to a hot water outlet B at the heat exchanger 8 and a bypass flow path C configured to mix tap water with hot water are connected to each other by an integrally injection-molded pipe body 120.

Referring to FIG. 3, the pipe body 120 includes a tap water inlet part 121 coupled to a connecting pipe 121*a* at a side of the tap water inlet A and disposed at a right lower end of the pipe body, and a flow rate sensor insertion part 122, into which a flow rate sensor 130 is inserted, downwardly inclined from one side of the tap water inlet part 121, extending to be exposed to an outside of a water heater housing 110, and having a lower end to which a lower cover 122*a* is coupled.

In addition, at a right upper side of the flow rate sensor insertion part 122 of the pipe body 120, a mixing valve 140 extends to be inserted across the bypass flow path C, and a mixing valve insertion part 123 coupled to a fastening part ③ of the tap water inlet pipe 5, through which tap water introduced into the heat exchanger 8 flows, and a fastening part ⑥ of the hot water supply pipe 9, through which heated hot water is supplied from the heat exchanger 8, is formed.

According to the structure of the pipe body 120, a flow path is formed such that the tap water introduced into the tap water inlet part 121 flows into the flow rate sensor insertion part 122 in a downwardly inclined direction, and is then conveyed toward the mixing valve insertion part 123.

In addition, a hot water outlet part 124 coupled to a connecting pipe 124*a* at a side of the hot water outlet B extends downward from a left side of the mixing valve insertion part 123 of the pipe body 120, and a flow rate control valve insertion part 125, into which a flow rate control valve 150 is inserted, is formed at an upper side opposite to the hot water outlet part 124.

The connecting pipes are fastened to 8 fastening parts, represented by ① to ⑧ of FIG. 3 at the pipe body 120 integrally injection-molded as described above, to form the entire flow path in the water heater 100.

According to the pipe connecting structure of the water heater in accordance with the present invention, the number of fastening parts of the connecting pipes in the conventional water heater 10 can be reduced from 12 to 8, and thus, the number of operations can be reduced and probability of leakage can also be reduced.

Meanwhile, the present invention is characterized in that the flow rate sensor 130, the mixing valve 140 and the flow rate control valve 150 are inserted and coupled in a direction parallel to the flow path direction from the outside of the pipe body 120 such that the flow rate sensor 130, the mixing valve 140 and the flow rate control valve 150 can be easily installed on and separated from the flow path in the water heater 100.

Here, the "flow path direction" refers to a direction in which a fluid is discharged from an outlet side of the flow rate sensor 130, the mixing valve 140 and the flow rate control valve 150.

When the flow rate sensor 130 is installed on the flow path through which tap water is introduced, the flow rate sensor 130 is inserted through the flow rate sensor insertion part 122 formed to be exposed to the outside of the water heater housing 110 and the lower cover 122*a* is press-fitted thereto. Here, no separate connecting pipe or fastening member is needed to install the flow rate sensor 130.

On the other hand, when the flow rate sensor 130 is separated, after the lower cover 122*a* coupled to the flow rate sensor insertion part 122 is extracted and separated therefrom, the flow rate sensor 130 is extracted to the outside.

When the mixing valve 140 and the flow rate control valve 150 are installed on the bypass flow path C and the flow path through which the hot water is supplied, respectively, the mixing valve 140 and the flow rate control valve 150 are inserted through the mixing valve insertion part 123 and the flow rate control valve insertion part 125 at the outside of the pipe body 120, and then fixed to the fastening parts ② and ⑦ by fastening members such as clips, etc., respectively.

On the other hand, when the mixing valve 140 and the flow rate control valve 150 are separated, the fastening members fastened to the fastening part ② and ⑦ are separated, and then the mixing valve 140 and the flow rate control valve 150 are extracted to the outside.

According to the pipe connecting structure of the water heater in accordance with the present invention, comparing the present invention with the conventional pipe connecting structure of the water heater, as the flow rate sensor 130, the mixing valve 140 and the flow rate control valve 150 are configured to be inserted and coupled into the pipe body 120 from the outside thereof, the number of connecting pipes can be reduced and thus maintenance thereof can be easily and rapidly performed.

The foregoing description concerns an exemplary embodiment of the invention, is intended to be illustrative, and should not be construed as limiting the invention. The present teachings can be readily applied to other types of devices and apparatuses. Many alternatives, modifications, and variations within the scope and spirit of the present invention will be apparent to those skilled in the art.

The invention claimed is:

1. A pipe connecting structure of a water heater including:
- a tap water inlet pipe connected to a heat exchanger at a tap water inlet,
- a hot water supply pipe connected to a hot water outlet at the heat exchanger,
- a flow rate sensor measuring flow rate of tap water introduced into the tap water inlet,
- a flow rate control valve controlling flow rate of hot water discharged at the hot water outlet,
- an integral pipe body connecting the tap water inlet, the tap water inlet pipe, the hot water supply pipe, and the hot water outlet,
- a bypass flow path connected between the tap water inlet pipe and the hot water supply pipe, and
- a mixing valve controlling the flow rate of the tap water conveyed through the bypass flow path, wherein
  - the bypass flow path is integral with the pipe body,
  - the mixing valve is coupled in a direction parallel to a flow path direction of the outlet of the fluid outside of the pipe body, and
  - the flow rate sensor and the flow rate control valve are coupled in the direction parallel to the flow path direction of the outlet of the fluid outside of the pipe body, and
- a mixing valve insertion part and a flow rate control valve insertion part located at the pipe body, wherein
  - the mixing valve and the flow rate control valve are located in the pipe body,
  - each of the mixing valve and the flow rate control valve has fastening parts, and
  - the fastening parts are coupled by fastening members.

2. A pipe connecting structure of a water heater including:
- a tap water inlet pipe connected to a heat exchanger at a tap water inlet,
- a hot water supply pipe connected to a hot water outlet at the heat exchanger,
- a flow rate sensor measuring flow rate of tap water introduced into the tap water inlet,
- a flow rate control valve controlling flow rate of hot water discharged at the hot water outlet,
- an integral pipe body connecting the tap water inlet, the tap water inlet pipe, the hot water supply pipe, and the hot water outlet, and
- a flow rate sensor insertion part, in which the flow rate sensor is located, the flow rate sensor insertion part being located at one side of the tap water inlet and exposed outside of the water heater housing.

3. The pipe connecting structure according to claim 2, wherein the flow rate sensor and the flow rate control valve are coupled in a direction parallel to a flow path direction toward an outlet of a fluid outside of the pipe body.

4. A pipe connecting structure of a water heater including:
- a tap water inlet pipe connected to a heat exchanger at a tap water inlet,
- a hot water supply pipe connected to a hot water outlet at the heat exchanger,
- a flow rate sensor measuring flow rate of tap water introduced into the tap water inlet,
- a flow rate control valve controlling flow rate of hot water discharged at the hot water outlet,
- an integral pipe body connecting the tap water inlet, the tap water inlet pipe, the hot water supply pipe, and the hot water outlet,
- a bypass flow path connected between the tap water inlet pipe and the hot water supply pipe,
- a mixing valve controlling the flow rate of the tap water conveyed through the bypass flow path, wherein
  - the bypass flow path is integral with the pipe body, and the pipe body comprises
    - a tap water inlet part coupled to a connecting pipe through which tap water is introduced,
    - a flow rate sensor insertion part in communication with the tap water inlet part, downwardly inclined from one side of the tap water inlet part and extending to and exposed outside of a water heater housing, and in which the flow rate sensor is located, and
    - a mixing valve insertion part extending to one side of an upper end of the flow rate sensor insertion part, with the mixing valve located in the mixing valve insertion part, and coupled to a connecting pipe of a tap water inlet pipe through which tap water is introduced into the heat exchanger, wherein the tap water introduced into the tap water inlet part is introduced into the flow rate sensor insertion part in a downwardly inclined direction, and conveyed toward the mixing valve insertion part.

5. The pipe connecting structure according to claim 4, wherein the flow rate sensor and the flow rate control valve are coupled in a direction parallel to a flow path direction toward an outlet of a fluid outside of the pipe body.

* * * * *